United States Patent [19]

Sutherland

[11] 3,950,963

[45] Apr. 20, 1976

[54] PORTABLE REFRIGERATING UNIT FOR FREEZE DRYING APPARATUS

[75] Inventor: David Theodore Sutherland, Woodstock, N.Y.

[73] Assignee: The Virtis Company, Gardiner, N.Y.

[22] Filed: Aug. 5, 1974

[21] Appl. No.: 494,385

[52] U.S. Cl. ..... 62/268; 34/92; 62/293; 62/394; 62/515; 165/74

[51] Int. Cl.[2] ..... F25B 19/00

[58] Field of Search ..... 62/448, 449, 450, 293, 62/394, 511, 515, 268; 165/73, DIG. 4; 34/92, 5

[56] References Cited

UNITED STATES PATENTS

| | | | |
|---|---|---|---|
| 2,376,373 | 5/1945 | Merckel | 165/74 |
| 2,449,127 | 9/1948 | Kleist | 165/74 |
| 2,486,957 | 11/1949 | McGrew | 62/448 |
| 3,271,874 | 9/1966 | Oppenheimer | 34/5 |
| 3,605,421 | 9/1971 | Patrick | 62/394 |

FOREIGN PATENTS OR APPLICATIONS

| | | | |
|---|---|---|---|
| 1,290,896 | 3/1962 | France | 62/448 |

*Primary Examiner*—William F. O'Dea
*Assistant Examiner*—Ronald C. Capossela
*Attorney, Agent, or Firm*—Haight, Hofeldt, Davis & Jambor

[57] ABSTRACT

A portable refrigerating unit has a condenser coil which may be inserted directly into the drying chamber of a freeze drying apparatus. A flexible tube is utilized to convey refrigerant to and from the condenser coil. The flexible tube and the condenser coil are connected through a closure member, which provides a vacuum tight seal for the drying chamber of the freeze drying apparatus. The closure member may be removed from the condenser coil, so that various closure sizes may be utilized and so that the condenser coil may be utilized as an immersible refrigerating device.

17 Claims, 5 Drawing Figures

11
13
15
17
19
21
23
24
25
26
27
29
2
33
35
31
67
61
39
41
49
57
53
37
45
55
43
51
73
71
3
63
59
65
69

PORTABLE REFRIGERATING UNIT FOR FREEZE DRYING APPARATUS

BACKGROUND OF THE INVENTION

1. Field of the Invention

This invention relates generally to a portable refrigerating unit for utilization with freeze drying equipment, and more specifically, this invention relates to a condenser coil arrangement for replacing the solvent/dry-ice coolers of the prior art.

2. Description of the Prior Art

While freeze drying is often thought of in connection with freeze dried coffee or dried blood plasma, there are myriad other uses for the freeze drying approach, especially in connection with laboratory testing and preservation. Basically, freeze drying involves lowering the temperature of a liquid sample or product until a completely solid state is reached (i.e., the product is frozen). This sample is then maintained in an area of very low absolute pressure or high vacuum and subjected to a controlled heat input. For many freeze drying applications, the ambient temperature of a room may suffice for the heat input, while for other applications a variable and much more accurately controlled heat input is required. Application of the heat to the product at a controlled rate results in the water content of the frozen sample being sublimated (i.e., converted directly from a solid to a gas without passing through the liquid state). The gaseous water vapor is then refrozen on the refrigerating unit for removal from the system, protecting the vacuum pump oil from water vapor contamination and resultant loss of pumping ability.

Various types of freeze drying units have been utilized in the past. In one type of prior art device, a large cabinet assembly incorporates a compressor, a vacuum pump and all the other equipment needed for the freeze drying operation. In one such device manufactured by The Virtis Company, a division of the assignee of this application, a stainless steel mechanically refrigerated condenser coil extends from the top of the cabinet into the drying chamber of the freeze drying apparatus. The condenser coil and the drum or manifold are affixed to the unit and form an integral portion thereof. While these devices have many uses, for many other applications they are too expensive, large, bulky, unwieldy and inflexible to meet a given need.

Accordingly, smaller, relatively inexpensive portable type freeze drying units have also been utilized in the past. In this type of device, the refrigerating unit is provided by a solvent bath cooled by dry-ice. While this type of device provides the desired portability for various uses, such as laboratory bench work, it does have the disadvantage that the dry-ice must be replenished at periodic intervals, often after normal working hours when the laboratory is unattended. In addition, the necessity of the solvent bath creates additional handling and flammability problems.

Some attempts have been made to improve upon the dry-ice portable freeze dryers by utilizing mechanically refrigerated condenser coils that are immersed in the solvent bath. These devices utilize a portable compressor that conveys refrigerant to the condenser coil through a flexible tube. However, these appproaches do not eliminate the necessity of handling the solvent bath. Further, this type of approach involves the additional problem of getting the condenser coil into the solvent bath and adds the disadvantage that it cools the solvent very slowly, unlike the dry-ice which it replaces.

SUMMARY OF THE INVENTION

By means of the present invention, there is provided a portable refrigerating unit for freeze drying apparatus which obviates the disadvantage of prior art devices. In accordance with the teachings of this invention, a small compact and completely portable freeze drying system is provided in which the necessity of a solvent bath is eliminated and a vacuum tight seal is provided for the drying chamber during operation of the freeze dryer.

A compressor is provided with a flexible tube, such as an outer sheath with a capillary located therein, to convey refrigerant to and from the compressor. The refrigerant is conveyed to a condenser unit or coil, which has inner and outer conduits, through a closure member that provides a vacuum tight seal for the drying chamber of the freeze drying apparatus. One appropriate type of closure member would be a flat transparent lucite plate, which permits the operator to view the ice accumulation on the condenser coil, adapted to rest on a sleeve or gasket of flexible material positioned about the top rim of the container forming the drying chamber. Other types of non-porous materials, such as metals, glass or plastics could also be used. In some applications, it is desirable to have suitable stops extending from the closure member to accurately position it with respect to the drying chamber.

In order to provide a continuous flow path for the refrigerant through the closure member, while yet preserving the vacuum tight seal of the drying chamber, a suitable connecting arrangement is utilized. In the connecting arrangement, a sealing disk having a diameter greater than the diameter of the opening through the closure member is positioned on one side of the opening. This sealing disk has a hole formed therein and a depending sleeve connected thereto, the sleeve being adapted to mate with the opening through the closure member. A bushing having a bore through the longitudinal direction thereof is connected to the disk, with the bore essentially aligned with the hole in the disk. The end of the bushing away from the disk is threaded on the external surface thereof. A washer having a diameter greater than the diameter of the opening in the closure member is located on the other side of the closure member and passed over the threads on the bushing. A nut is adapted to engage the threads on the bushing to force the washer against the closure member and draw the disk toward the closure member with a pinching action. To provide a vacuum tight seal, an O-ring of flexible material, such as rubber, may be placed about the sleeve extending from the disk, so that as the nut is tightened the disk compresses the O-ring to form the desired vacuum tight seal.

In order for the refrigerant to be passed from the flexible tube to the condenser coil, it is necessary that the flexible tube be affixed to the disk. This is accomplished by utilizing an adapter member that fits over and is connected to the disk and is connected to the outer sheath of the flexible tube. The outer conduit of the condenser coil is connected to the inner side of the threaded end of the bushing, while the inner conduit of the condenser coil is extended through the bushing and into the adapter member. The capillary is similarly extended beyond the end of the outer sheath, and into the inner conduit of the condenser coil, which is sufficiently large to receive it therein. The capillary is then connected to the inner conduit of the condenser coil.

As the capillary is spaced from the sheath of the flexible tube and the inner conduit of the condenser coil is spaced from the outer conduit, annular cavities are formed between the capillary and the sheath and between the inner and outer conduits of the condenser coil. Thus, the refrigerant is passed in a liquid state through the capillary to the inner conduit of the condenser coil. The inner conduit of the condenser coil terminates at a given distance from the end of the outer conduit, which is enclosed by a sealing cap. In this fashion, the refrigerant in its liquid state is passed into the annular cavity between the inner and outer conduits of the condenser coil, where it absorbs heat, expands and passes into the gaseous state. The refrigerant in this gaseous state is then returned to the compressor through the annular cavity between the inner and outer conduits of the condenser coil, the bushing, the adapter member and the annular cavity between the capillary and outer sheath of the flexible tube.

With this arrangement, a condenser coil is provided for recondensing the water vapor released during the freeze drying process, while maintaining a vacuum tight seal for the drying chamber. Within minutes the freeze drying process can be initiated, as there is no long wait to achieve freeze drying temperatures, as are needed with prior art devices. As a result of the transparent lucite plate used for the closure member, ice built up on the condenser coil may be observed and removed when necessary. Of course, the condenser coil could also be used as an immersible freezing unit for a freeze dryer, if so desired (although usually there would be no reason to do so), as the closure member is adapted to fit a conventional freeze drying container (manifold or drum). Normally, the condenser coil would be inserted into the container with the dry-ice and solvent bath central container removed. Further the condenser coil could be utilized as an immersible refrigerating unit without the closure member, by removing the nut and washer, passing them down over the condenser coil, and threading the condenser coil through the opening in the closure member.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figures 1, 2:
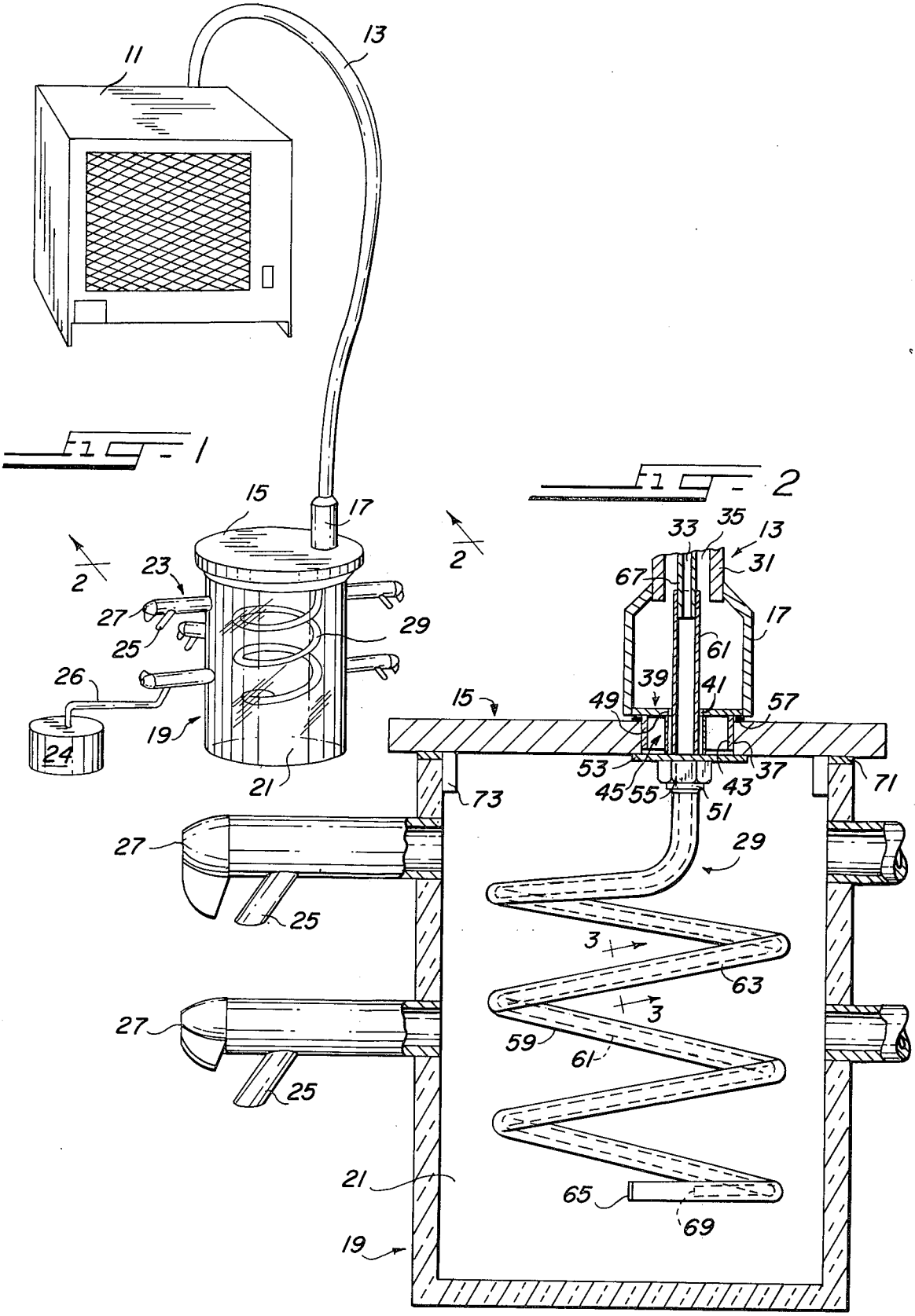
FIG. 1 is a schematic perspective view illustrating a freeze drying system incorporating the portable refrigerating unit of this invention.
FIG. 2 is a partial cross-sectional view taken along line 2—2 of FIG. 1.
Figure 3:
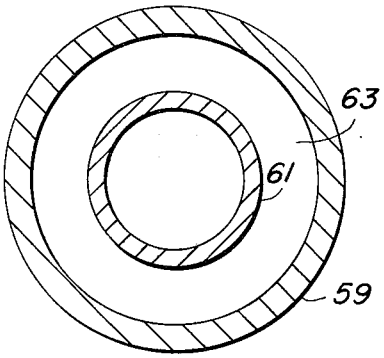
FIG. 3 is a cross-sectional view taken along line 3—3 of FIG. 2.

With reference to the drawing, in FIG. 1 there is illustrated a freeze drying system constructed in accordance with the present invention. A compressor 11 is provided. Compressor 11 may be any standard type of compressor, but preferably small and portable to provide maximum utilization of this freeze drying system. A suitable refrigerant is passed out of the compressor 11 in a liquid state through a flexible tube 13. The refrigerant returns in a gaseous state through this same flexible tube 13.

Flexible tube 13 is connected to a closure member 15 by a suitable plug member 17. The closure member 15 may be any appropriate shape or type of material, but in this preferred embodiment closure member 15 is a plate of clear lucite.

Closure member or plate 15 is located on a conventional freeze drying container, manifold, drum or pot 19. Freeze drying container or drum 19 may be made of any suitable material, such as stainless steel or lucite. In this preferred embodiment a transparent lucite is utilized to permit viewing of an internal drying chamber 21, but the closure member 15 is constructed to fit standard size freeze drying containers used with solvent dry-ice cooling. A plurality of port members 23 extend out from the drum 19. Port members 23 open into the drying chamber 21 and have depending cylindrical supports 25 on which containers for the sample or product being freeze dried may be positioned. A suitable valve arrangement, such as that disclosed in U.S. Pat. No. 3,509,909 — Bender et al, is utilized to alternately connect the supports 25 to the drying chamber 21 or to the atmosphere through the valve control handles 27. Each of the valve control handles 27 has an opening formed therein that connects with the passage through the associated port member 23. Thus, in one position of the handle 27 the passageway in the port member 23 is open between the support 25 and drying chamber 21, while being blocked between support 25 and the opening in handle 27. Conversely, in the opposite position of the handle 27 the passageway in the port member 23 is blocked between the support 25 and the drying chamber 21, while being open between support 25 and the opening in handle 27 to permit "bleeding off" of the vacuum that has been established in the sample holder (i.e., air is permitted to enter the sample holder).

A condenser coil 29 is located in the drying chamber 21. The condenser coil 29 is provided with refrigerant from the flexible tube 13. The refrigerant expands in the condenser coil and is returned to the compressor in the gaseous state.

In operation, a sample holder containing the product to be freeze dried in a frozen state is connected to a support 25. The valve control handle 27 is then set to connect that sample holder with the drying chamber 21. An appropriate vacuum pump, schematically illustrated at 24, is connected to another support 25, such as by a rubber tubing 26, and the valve control handle 27 for that port member is set to connect the vacuum pump to the drying chamber 21, so that a vacuum may be produced in the drying chamber 21. As the frozen water in the sample sublimates to water vapor, it passes over the condenser coil 29, where it is recondensed and frozen for subsequent removal.

With reference now to FIG. 2, it may be seen that the flexible tubing 13 has an outer sheath or conduit 31 and an inner conduit or capillary 33. Outer sheath 31 is any appropriate type of metallic flexible tubing, such as corrugated stainless steel covered with a stainless steel mesh, which is appropriately insulated. The capillary 33 is a conventional metallic conduit, such as copper tubing, that is small in diameter with respect to the internal diameter of the outer sheath, so that an annular cavity 35 is formed there between. The adapter member 17 is connected to the outer sheath 31 of the flexible tube 13 by any appropriate method, such as welding.

Conveyance of the refrigerant to the condenser coil 29 in the drying chamber 21 is effected through an opening 37 in the lucite plate 15. The other end of adapter 17 is fastened, such as by a weld joint, to the outer periphery of a sealing disk 39, which has a hole 41 formed in the central portion thereof. Sealing disk 39 has a diameter greater than the diameter of opening 37 in plate 15 and is formed of any suitable strong material, such as a metallic washer. A cylindrical sleeve 43 is connected to sealing disk 41 and extends outwardly therefrom. Sleeve 43 is adapted to fit snugly in opening 37 of plate 15.

Figure 4:
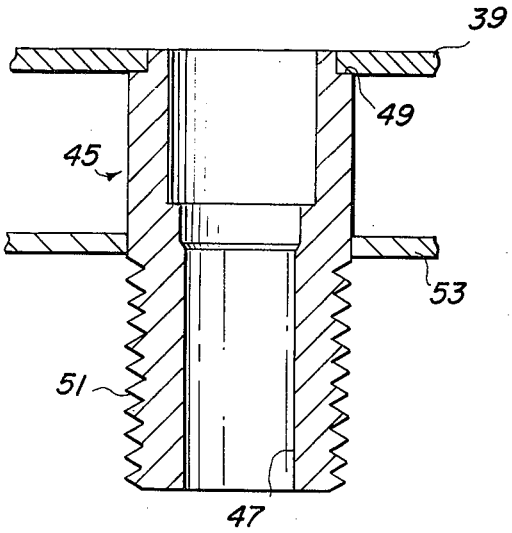
FIG. 4 is a cross-sectional view of the bushing utilized in the portable refrigerating unit of this invention.

Within sleeve 43 there is located a bushing 45, which is illustrated in more detail in FIG. 4. Bushing 45 has a bore 47 that is aligned with the hole 41 in sealing disk 39. A shoulder 49 is formed to abut against sealing disk 39 around the perimeter of hole 41. Bushing 45 is affixed to the sealing disk 39 at the point where shoulder 49 abuts disk 39, such as by welding. Threads 51 are formed on the end of bushing 45 away from the sealing disk 39.

A washer 53, having a diameter greater than the diameter of opening 37 in disk 15, is positioned on the other side of plate 15 (i.e., away from sealing disk 39). Washer 53 is adapted to easily pass over threads 51 on bushing 45. A nut 55 is adapted to engage threads 51 of bushing 45 after washer 53 has been slid thereover. An O-ring 57 is positioned about sleeve 43 adjacent sealing disk 39.

When nut 55 is engaged with threads 51, it bears against washer 53 which is driven against plate 15, and sealing disk 39 is drawn toward washer 53 and nut 51. Such action compresses the O-ring 57 so that an airtight or vacuum-tight seal is formed between sealing disk 39 and plate 15.

Condenser coil 29 has an outer conduit 59 and an inner conduit 61. These conduits may be made of any appropriate material, but in this preferred embodiment outer conduit is a stainless steel form, while inner conduit 61 is a copper tubing. Inner conduit 61 is sufficiently smaller than outer conduit 59 so that an annular cavity 63 is formed therebetween. A sealing cap 65 is located at the end of condenser coil 29 away from plate 15.

Figure 5:
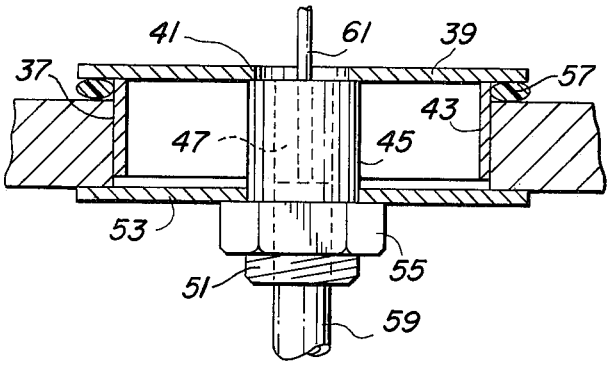
FIG. 5 is an enlarged cross-sectional view illustrating the connecting arrangement utilized in the portable refrigerating unit of this invention.

As illustrated in FIG. 5, outer conduit 59 is inserted into the bore 47 of bushing 45 and bonded thereto, such as by a heliarc weld. Inner conduit 61 extends through the bushing and into the adapter member 17. Inner conduit 61 has an internal diameter sufficiently large to receive capillary 33 therein. Capillary 33 is inserted into conduit 61 and fixed thereto at point 67 by an appropriate means, such as a weld. With this arrangement, refrigerant in a liquid state is passed through capillary 33 and into conduit 61 of the condenser coil. As end 69 of conduit 61 is set back from sealing cap 65 at the end of the outer conduit 59, liquid refrigerant passes into the cavity 63 between conduits 59 and 61, where it absorbs heat from water vapor in the drying chamber 21 causing it to condense on the coil, expands and passes into the gaseous state. The expanded refrigerant in the gaseous state thus passes through the cavity 63, bore 47 of bushing 45, adapter member 17 and the cavity 35 between sheath 31 and capillary 33 of the flexible tube 13.

In order to assure a vacuum-tight seal between plate 15 and the container 19, a rubber (or other flexible material) sleeve 71 may be located about the top of container 19. Thus, as a vacuum is created in drying chamber 21 the force on plate 15 will cause it to bear against the flexible sleeve 71 to provide the desired vacuum-tight seal.

While in most applications the plate 15 may just be set directly on top of the container 19, in some cases it may be desirable to position the plate 15 with respect to the container 19. Thus, stops 73 may be attached to plate 15 to appropriately position the plate 15 with respect to the open end of container 19. Any desired number of stops may be utilized, or the stops may be expanded into a solid ring, but in this preferred embodiment four equally spaced stops are utilized.

In view of the foregoing, it may be seen that a very advantageous portable refrigerating unit for freeze drying apparatus has been provided. This unit may be utilized with solvent/dry-ice type freeze drying drums or containers already possessed by the purchaser, merely by removing the solvent/dry-ice well previously utilized for refrigeration. Thus, a much more efficient and effective refrigeration system is provided, without requiring the purchaser to acquire a complete new freeze drying system. In addition, if for any reason it were desired to retain the solvent bath refrigeration, the condenser coil 29 could fit right into the solvent bath to provide this type of refrigerating device. Further, by removing nut 55 so that this nut and washer 53 can be passed over condenser coil 29, the condenser coil 29 may be threaded through opening 37 in plate 15 to provide an immersible refrigerating coil for other uses.

Another advantage of this arrangement that should be noted is that if the small capillary 33 should become clogged for any reason, the use of the larger inner conduit 61 in condenser coil 29 means that the capillary may be cleaned or replaced without having to withdraw the inner conduit 61, since it is sufficiently large to pass anything that gets through the capillary 33. Thus, by disconnecting adapter 17 from disk 39 and from sheath 31 of flexible tube 13, capillary 33 may be disconnected from tube 61 at point 67. By this approach, the condenser coil 29 does not have to be replaced as a result of a blockage in the capillary, as would be the case if the capillary extended the whole way through the condenser coil, since it is virtually impossible to remove the inner conduit 61 and then get it back into the outer conduit 59.

It should be understood that various modifications, changes and variations may be made in the arrangements, operations and details of construction of the elements disclosed herein without departing from the spirit and scope of this invention.

I claim:

1. A portable refrigerating unit for freeze drying apparatus, which has a container forming a drying chamber, comprising:

a compressor;

a flexible tube to convey refrigerant to said compressor and extending out from said compressor;

a closure member having an opening therethrough and adapted to removably enclose the drying chamber of the freeze drying apparatus with a vacuum-tight seal;

a condenser unit to be inserted directly into the drying chamber; and connecting means to releasably maintain said closure member in a unitary structure with said flexible tube and said condenser unit to permit replacement of said closure member without disconnecting said flexible tube and said condenser unit, said connecting means conveying the refrigerant between said flexible tube and said condenser unit through said opening of said closure member and closing said opening to provide a vacuum-tight seal between the drying chamber and the ambient environment.

2. A portable refrigerating unit as claimed in claim 1 wherein:

said closure member is transparent to permit viewing of said condenser unit in the drying chamber;

said opening in said closure member is sufficiently large to permit said closure member to be passed over said condenser unit; and said connecting means comprises a flexible sealing member to provide a vacuum-tight seal between said connecting means and said closure member.

3. A portable refrigerating unit as claimed in claim 2 wherein said closure member is a flat plate that rests on a gasket of flexible material positioned around the upper rim of the container forming the drying chamber.

4. A portable refrigerating unit for freeze drying apparatus, which has a container forming a drying chamber, comprising:

a compressor;

a flexible tube to convey refrigerant to and from said compressor and extending out from said compressor, said flexible tube comprising an outer sheath and an inner capillary, with an annular cavity between said sheath and said capillary;

a closure member having an opening therethrough and adapted to removably enclose the drying chamber of the freeze drying apparatus with a vacuum-tight seal;

a condenser unit to be inserted directly into the drying chamber, said condenser unit comprising an inner conduit and an outer conduit with an annular cavity therebetween, said inner conduit being releasably fastened to said capillary;

connecting means to releasably maintain said closure member in a unitary structure with said flexible tube and said condenser unit and to convey the refrigerant between said flexible tube and said condenser unit through said opening of said closure member, the refrigerant being passed in a liquid state through said capillary and said inner conduit and returned to the compressor in an expanded gaseous state through said annular cavities and said connecting means, said connecting means closing said opening to provide a vacuum-tight seal between the drying chamber and the ambient environment.

5. A portable refrigerating unit as claimed in claim 4 wherein said inner conduit of said condenser unit has an internal diameter sufficiently large to receive said capillary therein.

6. A portable refrigerating unit for freeze drying apparatus, which has a container forming a drying chamber, comprising:

a compressor;

a flexible tube to convey refrigerant to and from said compressor and extending out from said compressor, said flexible tube comprising an outer sheath and an inner capillary, with an annular cavity between said sheath and said capillary;

a closure member having an opening therethrough and adapted to enclose the drying chamber of the freeze drying apparatus with a vacuum-tight seal;

a condenser unit comprising an inner conduit and an outer conduit with an annular cavity therebetween, the refrigerant being passed in a liquid state through said capillary and said inner conduit and return to the compressor in an expanded gaseous state through said annular cavities;

a sealing disk having a diameter greater than the diameter of said opening in said closure member, said sealing disk having a hole in the central portion thereof and an extending sleeve that mates with said opening in said closure member, said flexible tube being connected to said sealing disk;

an O-ring located about said sleeve adjacent said sealing disk;

a bushing with an internal bore connected to said sealing disk and extending through said opening in said closure member;

threads formed on the outer surface of said bushing at the end away from said sealing disk, said condenser unit being fixedly connected to the internal surface of said threaded end of said bushing;

a washer having a diameter greater than the diameter of said opening in said closure member and adapted to pass over the threads on said bushing; and a nut adapted to engage said threads on said bushing, engagement of said nut with said threads on said bushing resulting in said nut bearing against said washer to draw said bushing and said sealing disk toward said nut to cause said sealing disk to compress said O-ring to form a vacuum-tight seal between the drying chamber and the ambient environment.

7. A portable refrigerating unit as claimed in claim 6 wherein said inner conduit of said condensing coil has an internal diameter sufficiently large to receive said capillary therein and said capillary is connected to the internal surface of said inner conduit of said condenser coil.

8. A portable refrigerating unit as claimed in claim 7 wherein an adapter member is connected to and extends from the end of said flexible tube to said sealing disk, the connection between said capillary and said inner conduit of said condenser coil being in said adapter member.

9. A portable refrigerating unit as claimed in claim 7 wherein said nut and said washer may be removed from said bushing and passed over said condenser coil so that said condenser coil may be passed through said opening in said closure member to provide an immersible refrigerating device.

10. A portable refrigerating unit for freeze drying apparatus, which has a container forming a drying chamber, comprising:

a compressor;

a flexible tube to convey refrigerant to and from said compressor and extending out from said compressor;

a closure member having an opening therethrough and adapted to removably enclose the drying chamber of the freeze drying apparatus with a vacuum-tight seal;

extending stops located on said closure member to accurately position said closure member with respect to the drying chamber;

a condenser unit to be inserted directly into the drying chamber; and connecting means to releasably maintain said closure member in a unitary structure with said flexible tube and said condenser unit and to convey the refrigerant between said flexible tube and said condenser unit through said opening of said closure member, said connecting means closing said opening to provide a vacuum-tight seal between the drying chamber and the ambient environment.

11. A portable refrigerating unit for freeze drying apparatus, which has a container forming a drying chamber, comprising:

a compressor;

a flexible tube to convey refrigerant to and from said compressor and extending out from said compressor, said flexible tube having an outer sheath and an inner capillary with an annular cavity between said sheath and said capillary;

a plate having an opening therethrough and adapted to enclose the drying chamber of the freeze drying apparatus with a vacuum tight seal;

a condenser coil having an inner conduit and an outer conduit with an annular cavity therebetween;

a sealing disk having a diameter greater than the diameter of said opening in said plate, said sealing disk having a circular hole in the central portion thereof and an extending cylindrical sleeve encompassing said hole and adopted to mate with said opening in said plate;

a flexible O-ring located about said sleeve adjacent said sealing disk;

a bushing having a central bore connected to said sealing disk with said bore aligned with said hole in said disk and extending through said opening in said plate;

threads formed on the outer surface of said bushing at the end away from said sealing disk, said outer conduit of said condenser coil being fixedly connected to the internal surface of said threaded end of said bushing;

a washer having a diameter greater than the diameter of said opening in said plate and adapted to pass over the threads on said bushing;

a nut adapted to engage said threads on said bushing, engagement of said nut with said threads on said bushing resulting in said nut bearing against said washer to draw said bushing and said sealing disk toward said nut to cause said sealing disk to compress said O-ring to form a vacuum-tight seal;

an adapter member having one end thereof connected to said sheath of said flexible tube and the other end thereof encompassing and connected to said sealing disk, said inner conduit of said condenser coil extending beyond said outer conduit and through said bore of said bushing and said hole in said sealing disk, said capillary extending beyond said sheath and fitted inside said inner conduit and connected thereto; and a sealing cap at the end of said outer conduit of said condenser coil away from said plate, said inner conduit terminating at a point spaced from said sealing cap so that the refrigerant is passed in a liquid state through said capillary and said inner conduit and returned to the compressor in an expanded gaseous state through said annular cavities, said bushing and said adapter member.

12. A portable refrigerating unit as claimed in claim 11 wherein said plate is formed of a transparent lucite to permit observation of said condenser coil in the drying chamber.

13. A portable refrigerating unit as claimed in claim 12 wherein extending stops are located on said lucite plate to accurately position said plate with respect to the drying chamber.

14. A portable refrigerating unit as claimed in claim 11 wherein said nut and said washer may be removed from said bushing and passed over said condenser coil so that said condenser coil may be passed through said opening in said plate to provide an immersible refrigerating device.

15. An arrangement for interconnecting a first refrigerant conveying tube, having first inner and outer conduits, and a second refrigerant conveying tube, having second inner and outer conduits, through an opening in a member comprising:

a disk having a diameter greater than the diameter of the opening, said disk having a hole therein and an extending sleeve that mates with the opening in the member, the first outer conduit being connected to said disk;

a bushing having a bore aligned with said hole in said disk, connected at one end thereof to said disk, and extending through the opening in the member;

threads formed on the outer surface of said bushing at the end away from said disk, the second outer conduit connected to the inner surface of the threaded end of said bushing, the second inner conduit extending beyond the second outer conduit through said bushing and said hole in said disk to be connected to the first inner conduit;

a washer having a diameter greater than the diameter of the opening and adapted to pass over said threads on said bushing; and a nut adapted to engage said threads on said bushing to force said disk and said washer toward each other on opposite sides of the member in which the opening is located.

16. An arrangement as claimed in claim 15 and further comprising a flexible O-ring located about said sleeve adjacent said disk for compression upon engagement of said nut with said threads on said bushing.

17. An arrangement as claimed in claim 15 wherein the first inner conduit is a capillary that fits inside and is connected to the second inner conduit, the second refrigerant conveying tube being a condenser coil, the refrigerant passing through the capillary and the second inner conduit in a liquid state and returning through annular cavities between the first and second inner and outer conduits in an expanded gaseous state.

* * * * *